US005094357A

United States Patent [19]

McKinney

[11] Patent Number: 5,094,357

[45] Date of Patent: Mar. 10, 1992

[54] TAMPER EVIDENT SEAL

[75] Inventor: James McKinney, Pega Cay, S.C.

[73] Assignee: Colgate-Palmolive Co., Piscataway, N.J.

[21] Appl. No.: 477,014

[22] Filed: Feb. 7, 1990

[51] Int. Cl.[5] ..... B65D 53/00

[52] U.S. Cl. ..... 220/214; 220/266; 220/269; 215/253; 215/258

[58] Field of Search ..... 220/269, 214, 266, 270; 215/232, 250, 253, 258, 254, 230

[56] References Cited

U.S. PATENT DOCUMENTS

| | | | |
|---|---|---|---|
| 577,640 | 2/1897 | Bokelmann | 215/258 |
| 1,798,151 | 3/1931 | Fabrice | 215/258 |
| 3,255,928 | 6/1966 | Foster | 222/153 |
| 3,794,098 | 2/1974 | Versen | 220/214 X |
| 3,838,785 | 10/1974 | Lancesseur | 215/251 |
| 3,952,869 | 4/1976 | Sansom | 220/214 X |
| 4,028,043 | 6/1977 | Neyret | 431/144 |
| 4,227,620 | 10/1980 | Conway | 215/355 |
| 4,371,092 | 2/1983 | Teague | 220/324 |
| 4,621,744 | 11/1986 | Foster | 220/270 |
| 4,702,383 | 10/1987 | Wender | 215/232 |
| 4,776,476 | 10/1988 | Simard | 215/230 |
| 4,813,541 | 3/1989 | Velasco et al. | 220/214 X |
| 4,927,048 | 5/1990 | Howard | 220/90.2 |
| 4,984,700 | 1/1991 | Knickerbocker | 215/251 |
| 5,012,940 | 5/1991 | Koehn | 215/230 |

FOREIGN PATENT DOCUMENTS 275491 8/1927 United Kingdom .

*Primary Examiner*—Stephen Marcus
*Assistant Examiner*—Nova Stucker
*Attorney, Agent, or Firm*—Michael J. McGreal; Murray M. Grill; Robert C. Sullivan

[57] ABSTRACT

A tamper evident seal for a container is provided by a tab which is preferably of a different color from the container. This tab has a portion that will be left on the container sidewall or lid. When only this portion of the tab is on the container sidewall or lid, there is clear evidence of tampering.

22 Claims, 2 Drawing Sheets

TAMPER EVIDENT SEAL

BACKGROUND OF THE INVENTION

This invention relates to a tamper evident seal for a container. More particularly, this invention relates to a tab that extends from the closure along a wall of the container with a portion of the tab being attached to the container wall.

In the packaging art area, there is a continual need for techniques of packaging whereby if the packaging has been subject to tampering that this is readily discernable by the consumer. Due to the instances where various products have undergone tampering with the result that purchasers of these products have been seriously injured, there is a continual need for techniques for providing packaging with tamper evident seals. A tamper evident seal is any type of seal whereby if the package has been opened so as to subject the contents to tampering, that this is readily discernable from a cursory inspection of the package. In such an instance, the consumer will not purchase that package and will in most instances alert a store employee to the tampered item. Further, when via a cursory view it can be readily discovered whether a package has undergone tampering, this can be discovered in most instances by store personnel who are restocking shelves or who are realigning products on the shelves. The objective with regard to such packaging is to alert both consumers and store sales personnel with regard to products which may have undergone tampering. In this way, such products can be quickly removed from the shelves and tested. If upon testing it is discovered that the product has actually undergone tampering, an investigation can be initiated prior to any consumer injury.

Depending on the type of container, various techniques have been developed for providing a tamper evident seal for the container. Shrink film seals have been utilized around the neck of containers in order to alert potential purchasers whether a product may have undergone tampering. Further, many containers utilize a foil seal, which if broken, alerts purchases to possible product tampering. There are yet other techniques for producing tamper evident seals. The objective is to have an essentially foolproof tamper evident seal but yet one which has a relatively low cost.

The present tamper evident seal is very useful with regard to plastic containers. This is the case since it would be relatively easy to bond a plastic tab onto plastic containers. It also provides a technique for informing the consumer when such a container has undergone tampering. Further, with the increasing use of plastic containers for various products such as foods, medicines and cosmetics, it has been necessary to devise new and better techniques for providing the consumer with possible evidence of tampering when there has been an incident of tampering.

As has been noted, various techniques have been used in the prior art to provide for tamper evident seals. In U.S. Pat. No. 577,640, there is shown a technique for providing a tamper evident seal for bottles, such as liquor bottles. In order for the cork to be removed from a bottle, it is necessary to destroy the seal attachment before the bottle. Thus, when the seal attachment is broken, there is no clear evidence that the bottle has undergone tampering. In U.S. Pat. No. 1,798,151, there is shown another tamper evident seal technique for a bottle. In this patent, there is disclosed a seal which is broken at an intermediate point so that the bottle can be opened and its contents used. However, if the seal is broken at this intermediate point, there is clear evidence that the bottle has undergone tampering.

U.S. Pat. No. 3,255,928 discloses a tamper proof closure for a dispensing container. In this patent, there is disclosed a seal with this seal having a frangible tab area. The seal includes a section which engages the top portion of the container and which extends downwardly along the side of the container to the bottom of the container. At the bottom of the container, the seal via the tap portion, is connected to the bottom portion of the container. To open, the tab is pulled and the seal broken. The upper portion which covers a dispensing opening can then be drawn open so that product can be dispensed.

U.S. Pat. No. 3,838,785 discloses a tamper proof plastic cap. This cap consists of two portions. One portion of the cap sealably engages the top of a container. This first portion also has on the top thereof, a region into which a part of the second part can be engaged. The second part of the tamper proof plastic cap then extends downwardly over the first part with a center projecting section extending into the aforementioned region of the first part. Now, in order for the container to be opened, the second part must be removed. However, when the second part is removed, the second portion of the second part remains engaged in the first part. Thus, if a consumer sees a part of the second portion of the seal remaining engaged into the first part of the seal, there is clear evidence that the bottle has undergone tampering.

U.S. Pat. No. 4,028,043 discloses a cigarette lighter with tamper proof protection so as to protect the cigarette lighter prior to sale. Tamper proof means consist of a tab which blocks or covers the rotating flint wheel and a cover over the flame outlet portion. Thus, in order to utilize the lighter, the tab which extends over or which blocks the flint wheel must be removed so as to make the flint wheel usable and to expose the flame portion. Thus, if the cigarette lighter does not have this mechanism in place at the time of purchase, the consumer quickly releases that it has undergone tampering.

The present tamper evident seal provides a simple technique for clearly informing the consumer when a product has undergone tampering. That is, it provides clear and convincing evidence to a consumer which container has been opened and resealed.

BRIEF DESCRIPTION OF THE INVENTION

The present invention is directed to a technique for providing a tamper evident seal for containers. In particular, the present invention is directed to a tamper evident seal for plastic containers. The tamper evident seal can be of either of two embodiments. The tamper evident seal consists of a tab which sealably engages the top closure portion of the container and also a portion of the sidewall of the container. In one embodiment, at least a substantial portion of the tab is attached to the container closure or the container side. On the part where the tamper evident seal tab has not been so attached, it is attached only in one particular region. Further, this one particular region where the tab is connected to the container is surrounded by a frangible area. As has been noted, this region of the tab that is sealed to the container and which is surrounded by a frangible area can be attached to either the side of the container or to the top closure portion of the container.

When it is desired to open the present containers, it is only necessary to grip the tab at the portion that extends below the region that has been attached to the container and to pull either outwardly or upwardly depending on whether this region of the tab is attached to the top closure of the container or to the side wall of the container. Preferably, the tab along with the region of the tab that is bonded to the container is of a color that is significantly different from that of the container. In this way, it can be readily by discerned if the container has undergone tampering. This is the case since a button of this plastic material remains attached to either the closure portion or the side wall of the container. This is clear evidence of an incident of tampering.

DETAILED DESCRIPTION OF THE INVENTION

The present tamper evident seal is of a type which produces highly visible evidence of any container tampering. In the preferred mode, the tab which comprises the tamper evident seal is of a color which is different from the remainder of the container. In this way, the part of the tab which is left attached to the container becomes highly visible. The tab portion would then be a highly visual color such as red. That is, there would be a portion of the red disk or other shaped piece remaining on the container body or on the container lid. The appearance of such a ragged piece of a different color on the container body or the container lid would be clear warning to the consumer that the container had undergone tampering.

Figure 1:
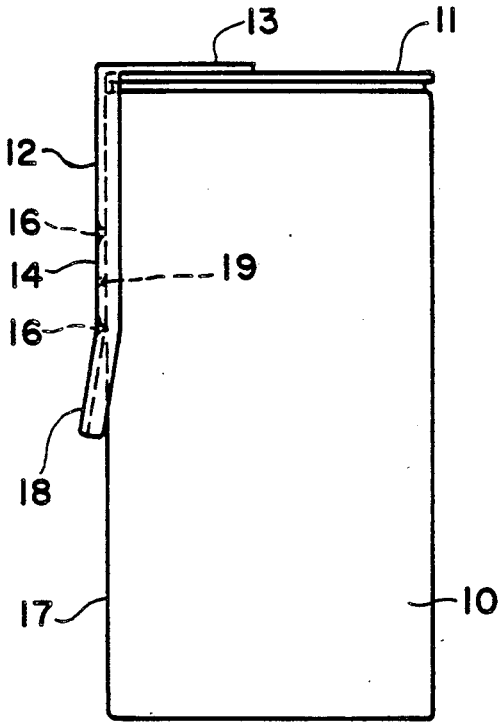
FIG. 1 is a side elevational view of a container which utilizes one of the embodiments of the present invention.

The present invention will be discussed with particular reference to the drawings. In FIG. 1, there is shown a side elevational view of the closure seal arrangement whereby upon opening the container, a portion of the tab is left on the container body. In this figure, container 10 has a lid 11. Bonded to lid 11 is portion 13 of the tab. The tab then extends downwardly along side 17 of the container. Extending downwardly is portion 12 of the tab which is not attached to the side of the container in any manner. Portion 14 of the tab is attached to the container. Extending below portion 14 is portion 18 which is a gripping portion of the tab. Surrounding portion 14, which is attached to the container, is preferably a weakened area 16. This weakened area 16 can be continuous or non-continuous in nature. Further, if the tab portion is constructed from a material which can be fairly easily torn, there need not be any weakened area surrounding the portion 14 which is attached to the side of the container. It is seen from this structure that the lid 11 of the container is maintained in a closed position as long as the tab portion 13 and the portion which extends down the side of the container are attached to the lid portion and to the container wall respectively.

Figure 2:
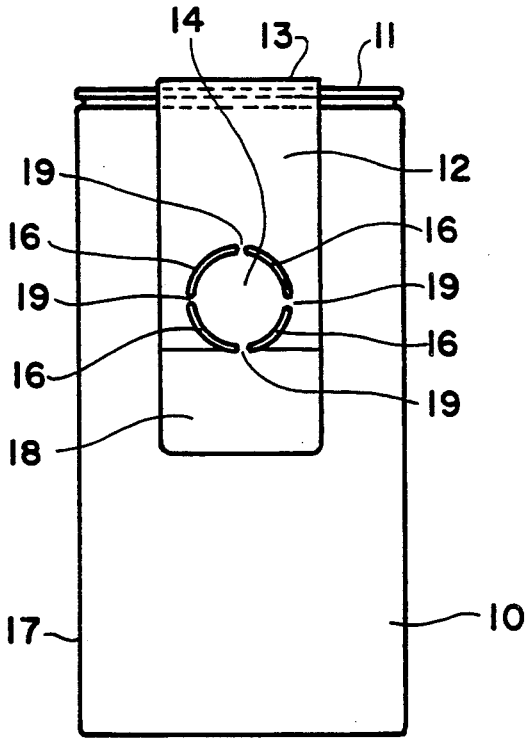
FIG. 2 is a side elevational view of a container with the tamper evident seal of FIG. 1.

In FIG. 2, there is shown a front elevational view of this container. In this view, the portion of the tab which is connected to the container sidewall is shown as surrounded by a plurality of weakened areas 16. In this instance, the weakened areas consist of four partially scored portions. Between each of these scored portions is an area 19 which is the same thickness as the tab. Rather than there being partially scored portions, these can be fully scored, or the weakened area can be comprised of a serrated region around the portion that is attached to the container. Other techniques for producing a weakened area can also be utilized.

Figure 3:
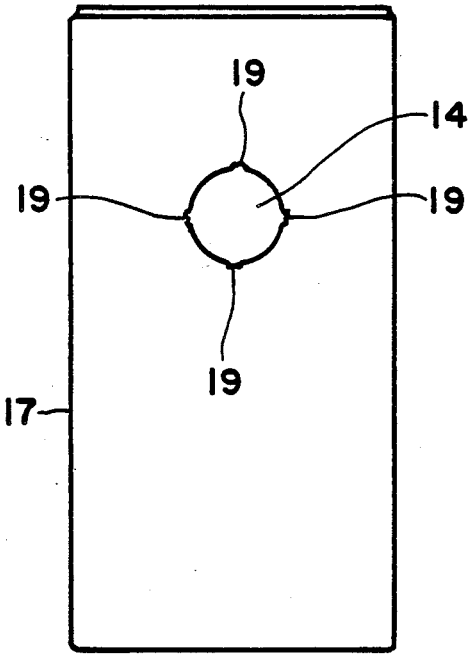
FIG. 3 is a side elevational view of the container of FIG. 2 where the tamper evident seal has been removed.
Figure 4:
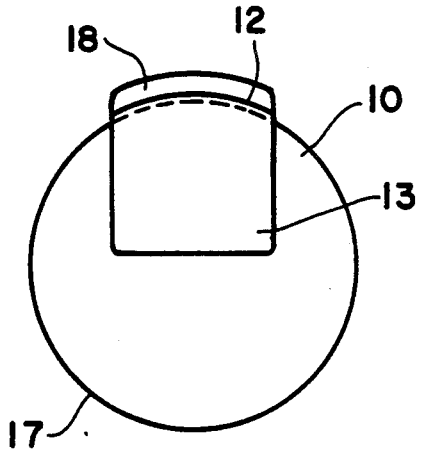
FIG. 4 is a top view of the container of FIG. 1.

FIG. 3, there is shown the container of FIGS. 1 and 2 with the tab removed in order to open the container. In this view, the lid has been removed. The tab will remain attached to the lid since the portion of the tab 13 remains attached to the lid. Upon gripping portion 18 and pulling outward and upward, the scored areas 16 and the solid areas 19 are severed from portion 14 which is attached to the container sidewall. There thus remains attached to the container sidewall, that portion 19 having a non-uniform outer edge. This non-uniform outer edge is the result of the scored portion 16 and the non-scored portion 19, not breaking in the same manner. Considering that this attached portion 14 is of a significantly different color than the sidewall of the container, there remains present on the container 10 a button or other shaped item having a different color. This results in fairly informing the consumer that the container has undergone tampering.

Figure 5:
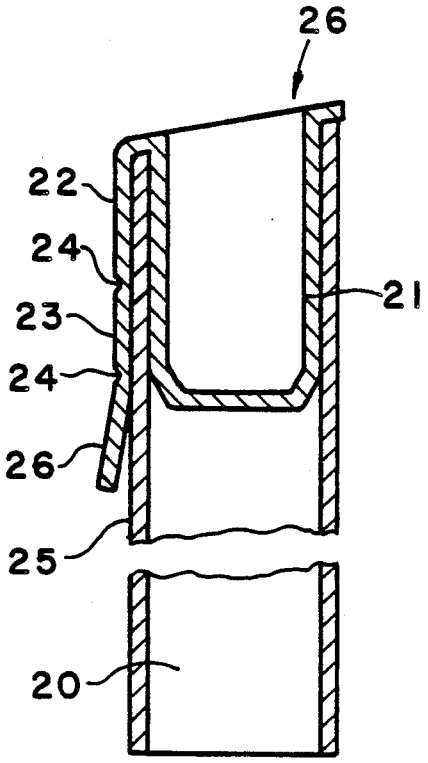
FIG. 5 is a side elevational view in section of an embodiment whereby the tamper evident seal is utilized in connection with a plug type closure.

FIG. 5, this tab is shown as a part of plug structure. In this instance, the plug itself becomes part of the tab. In this view, plug 26 consists of wall structure 21 for the portion that extends downwardly into spout 20. The spout 20 is comprised of spout walls 25. In this view, a tab which is an integral part of the spout plug extends over and downwardly along the outside of spout wall 25. This tab consists of portion 22 which is not attached to spout wall 25. Portion 23 of the tab is attached to spout wall 25. Shown surrounding the portion 23 which is attached to the spout wall is weakened area 21. Extending below the portion of the tab and below the portion which is attached to the spout wall is gripping portion 26. As in the container of FIGS. 1, 2, 3, in order to remove the plug, the portion 26 is grabbed and pulled upwardly and outwardly so as to break the frangible areas surrounding this portion which is attached to the spout. When this occurs, there results the same evidence of tampering as has been shown in FIG. 3 and explained with regard to FIG. 3. Upon the tab being broken away from portion 23 which is attached to the spout wall, there is left a button 14. As in the previous embodiment through the use of a different color for the tab than from the spout sidewall. There can be produced clear and convincing evidence that the container has undergone tampering.

Figure 6:
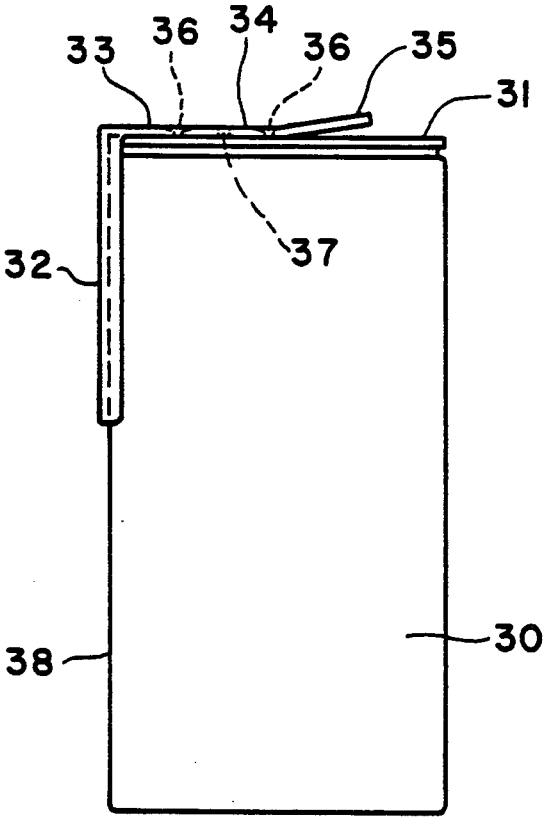
FIG. 6 shows the embodiment where the seal tab of the tamper evident seal is attached to the closure of the container rather than the side wall of the container.
Figure 7:
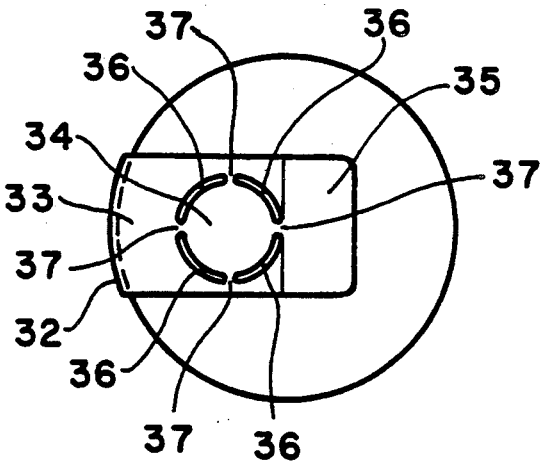
FIG. 7 is a top view of the container of FIG. 5 with the tamper evident seal in place.
Figure 8:
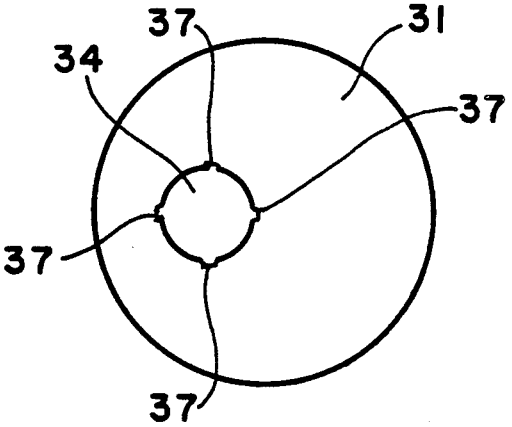
FIG. 8 is a top view of the container of FIG. 5 with the tamper evident seal having been removed.

FIGS. 6, 7 and 8 show the embodiment where the portion of the tab that was bonded to the lid is now bonded to the inside of the container. Further, the frangible portion of the tab is attached to the lid rather than to the side of the container. That is, the tab has been reversed with regard to its connection to the container. In FIG. 6, there is shown container 30 with lid 31. The lid portion of the tab in this embodiment consists of portion 33 which is not bonded to the lid, portion 34 which is attached to the lid, and portion 35 which is adapted to be gripped in order to remove the tab from the container. The portion 34 which is bonded to the lid is surrounded by the frangible area. In FIG. 7, there is shown a top view of the container with the tab and lid in place. In order to open the container, it is only necessary to grip the tab portion 35 and to move it upwardly and outwardly. When this is done, the weakened areas 36 readily break as do areas 37 between these weakened areas. In FIG. 8, there is shown that remains after the tab has been fully removed from the lid portion of the container. These remains the portion 34 that is attached to the lid and irregular edges 37 which are produced when the tab is removed. Assuming the tab to be of a significantly different color from the lid cover in this embodiment, there would be left clear and convincing evidence that the package has been previously opened. If the package is still within a store, it would be advisable to bring this to the attention of store management.

The containers, including the lids, can be constructed out of any substance to which the tab can be readily attached. This attaching can be by means of heat bonding, by adhesive bonding or some mechanical means such as rivoting. In this regard, the containers can very conveniently be made out of polyester or polyene polymers. The tab itself would be constructed from a substance which can be readily attached to the sidewall of the container or the lid of the container. In this regard, both the container and the tab can be conveniently constructed out of a polyester or from polyene monomers and copolymers. With regard to these different materials, it is preferred to utilize polyenes rather than polyesters. Suitable polyenes include polyethylene, polypropylene, polyisobutylene, copolymers of polyethylene, polypropylene, polyisobutylene and the like. The preferred materials of construction are polyenes.

Variations can be made with regard to the design and layout of the tab. However, having a frangible portion of the tab that is bonded to the container in which a portion will be left attached if the container is prematurely opened provides clear and convincing evidence. Further, although discussed primarily for use with plastic containers, this can be readily utilized with regard to other containers. This is the case since the portion of the tab which is connected to the container and surrounded by a frangible region will be left attached to the container. Since the container and tab will be of distinctive colors, any tampering with the product will be quite evident.

I claim:

1. A tamper evident seal for a container comprising a container body having a sidewall and a top surface and a closure for closing an opening in the top surface, a tab extending from said closure at least partially down the sidewall of said container and having means to be gripped thereon, adjacent said means to be gripped a portion of said tab is attached to said container and has a frangible region surrounding the portion of said tab which is attached to said container whereby to open said container the means to be gripped is pulled with a sufficient force to fracture the frangible region of said tab to leave the tab portion within the frangible region attached to said container with the remainder of said tab remaining attached to said closure, the part of the tab remaining attached to said container having an irregular edge to further evidence that said container has been opened.

2. A tamper evident seal as in claim 1 wherein said frangible region of said tab is a scored region.

3. A tamper evident seal as in claim 1 wherein said frangible region consists of a plurality of keepers.

4. A tamper evident seal as in claim 1 wherein said tab is a first color and said container is a second color.

5. A tamper evident seal as in claim 1 wherein said closure is a plug that fits into an opening in the top surface of the container.

6. A tamper evident seal as in claim 1 wherein said closure is a lid which substantially covers the top surface of said container.

7. A tamper evident seal as in claim 1 wherein the portion of said tab which is attached to said container is heat bonded to said container.

8. A tamper evident seal as in claim 1 wherein the portion of said tab which is attached to said container is adhesively bonded to said container.

9. A method of preventing tampering of a container by applying to a container having a sidewall a closure which has a pull tab extending therefrom, said tab being of a color different from that of said container, attaching a portion of said tab to said container sidewall and surrounding such portion of said tab with a frangible region whereby in order to open said container, the tab must be manipulated to exert a force sufficient to sever said tab from that portion that has been attached to the sidewall of said container which will leave the portion of said tab that has been attached to said sidewall with an irregular edge to evidence that said container has been opened.

10. A method of preventing tampering as in claim 9 wherein the portion of said tab attached to said container is heat bonded to said container.

11. A method of preventing tampering as in claim 9 wherein the portion of said tab attached to said container is adhesively bonded to said container.

12. A tamper evident seal for a container comprising a container body having at least one sidewall and a top surface and a closure for closing an opening in the top surface, a tab attached to an extending from said at least one sidewall of said container to said closure and having means to be gripped thereon, adjacent said means to be gripped a portion of said tab is attached to said closure and has a frangible region surrounding the portion of said tab which is attached to said closure whereby to open said container the means to be gripped is pulled with a sufficient force to fracture the frangible region of said tab to leave the tab portion within the frangible region attached to said closure with the remainder of said tab remaining attached to said container, the part of the tab remaining attached to said closure having an irregular edge to further evidence that said container has been opened.

13. A tamper evident seal as in claim 12 wherein said frangible region of said tab is a scored region.

14. A tamper evident seal as in claim 12 wherein said frangible region consists of a plurality of keepers.

15. A tamper evident seal as in claim 12 wherein said tab in a first color and said closure is a second color.

16. A tamper evident seal as in claim 12 wherein said closure is a plug that fits into an opening in the top surface of the container.

17. A tamper evident seal as in claim 12 wherein the portion of said tab which is attached to said closure is heat bonded to said closure.

18. A tamper evident seal as in claim 12 wherein the portion of said tab which is attached to said closure is adhesively bonded to said closure.

19. A tamper evident as in claim 12 wherein said closure seal is a lid which substantially covers the top surface of said container.

20. A method of preventing tampering of a container having a closure by applying to a container a pull tab, said tab being of a color different from that of said container, attaching a portion of said tab to said closure and surrounding such portion of said tab with a frangible region whereby in order to open said container, the tab must be manipulated to exert a force sufficient to sever said tab from that portion that has been attached to the closure of said container which will leave the portion of said tab that has been attached to said closure with an irregular edge to evidence that said container has been opened.

21. A method of preventing tampering as in claim 20 wherein the portion of said tab attached to said closure is heat bonded to said closure.

22. A method of preventing tampering as in claim 20 wherein the portion of said tab attached to said closure is adhesively bonded to said closure.

* * * * *